US005584456A

United States Patent [19]

Stephens

[11] Patent Number: 5,584,456

[45] Date of Patent: Dec. 17, 1996

[54] CHAIR ATTACHING TOWEL CLIP

[76] Inventor: Owen Stephens, 1891 S. Ocean Dr., #103, Hallandale, Fla. 33009

[21] Appl. No.: 494,843

[22] Filed: Jun. 26, 1995

[51] Int. Cl.[6] ..... A47B 96/06

[52] U.S. Cl. ..... 248/214; 248/316.5; 24/510; 24/339

[58] Field of Search ..... 248/214, 340, 248/316.5; 24/265 C, 509, 510, 490, 339

[56] References Cited

U.S. PATENT DOCUMENTS

| | | | |
|---|---|---|---|
| 407,966 | 1/1810 | Gonzalez | 248/316.7 |
| 510,468 | 12/1893 | Buehl | 248/316.5 |
| 714,348 | 11/1902 | Youngblood | 248/316.5 |
| 819,534 | 5/1906 | Frank | 24/510 |
| 2,038,043 | 4/1936 | Hasselblad | 248/316.5 |
| 3,349,453 | 10/1967 | Iida et al. | 24/510 |
| 4,614,008 | 9/1986 | Brill et al. | 24/510 |
| 4,707,906 | 11/1987 | Posey | 24/339 |

FOREIGN PATENT DOCUMENTS

| | | | |
|---|---|---|---|
| 843691 | 7/1952 | Germany | 24/510 |
| 23211 | of 1907 | United Kingdom | 248/316.5 |

*Primary Examiner*—Leslie A. Braun
*Assistant Examiner*—Willie Berry, Jr.

[57] ABSTRACT

A clip for securing a towel to a chair. The inventive device includes a mounting assembly for securing to a lounge chair. An engaging assembly projects from the mounting assembly for coupling to a beach towel to secure the towel relative to the lounge chair.

1 Claim, 3 Drawing Sheets

CHAIR ATTACHING TOWEL CLIP

BACKGROUND OF THE INVENTION

1. Field of the Invention

The present invention relates to securing structures and more particularly pertains to an chair attaching towel clip for securing a towel to a chair.

2. Description of the Prior Art

The use of securing structures is known in the prior art. More specifically, securing structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art securing structures include U.S. Pat. No. 4,858,285; U.S. Pat. No. 4,927,118; U.S. Pat. No. 4,273,380; U.S. Design Pat. No. 250,924; U.S. Design Pat. No. 315,675; and U.S. Design Pat. No. 342,890.

While these devices fulfill their respective, particular objectives and requirements, the aforementioned patents do not disclose a chair attaching towel clip for securing a towel to a chair which includes a mounting means for securing to a lounge chair, and an engaging means projecting from the mounting means for coupling to a beach towel to secure the towel relative to the lounge chair.

In these respects, the chair attaching towel clip according to the present invention substantially departs from the conventional concepts and designs of the prior art, and in so doing provides an apparatus primarily developed for the purpose of securing a towel to a chair.

SUMMARY OF THE INVENTION

In view of the foregoing disadvantages inherent in the known types of securing structures now present in the prior art, the present invention provides a new chair attaching towel clip construction wherein the same can be utilized for securing a towel to a chair. As such, the general purpose of the present invention, which will be described subsequently in greater detail, is to provide a new chair attaching towel clip apparatus and method which has many of the advantages of the securing structures mentioned heretofore and many novel features that result in a chair attaching towel clip which is not anticipated, rendered obvious, suggested, or even implied by any of the prior art securing structures, either alone or in any combination thereof.

To attain this, the present invention generally comprises a clip for securing a towel to a chair. The inventive device includes a mounting assembly for securing to a lounge chair. An engaging assembly projects from the mounting assembly for coupling to a beach towel to secure the towel relative to the lounge chair.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new chair attaching towel clip apparatus and method which has many of the advantages of the securing structures mentioned heretofore and many novel features that result in a chair attaching towel clip which is not anticipated, rendered obvious, suggested, or even implied by any of the prior art securing structures, either alone or in any combination thereof.

It is another object of the present invention to provide a new chair attaching towel clip which may be easily and efficiently manufactured and marketed.

It is a further object of the present invention to provide a new chair attaching towel clip which is of a durable and reliable construction.

An even further object of the present invention is to provide a new chair attaching towel clip which is susceptible of a low cost of manufacture with regard to both materials and labor, and which accordingly is then susceptible of low prices of sale to the consuming public, thereby making such chair attaching towel clips economically available to the buying public.

Still yet another object of the present invention is to provide a new chair attaching towel clip which provides in the apparatuses and methods of the prior art some of the advantages thereof, while simultaneously overcoming some of the disadvantages normally associated therewith.

Still another object of the present invention is to provide a new chair attaching towel clip for securing a towel clip to a chair.

Yet another object of the present invention is to provide a new chair attaching towel clip which includes a mounting means for securing to a lounge chair, and an engaging means projecting from the mounting means for coupling to a beach towel to secure the towel relative to the lounge chair.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2:
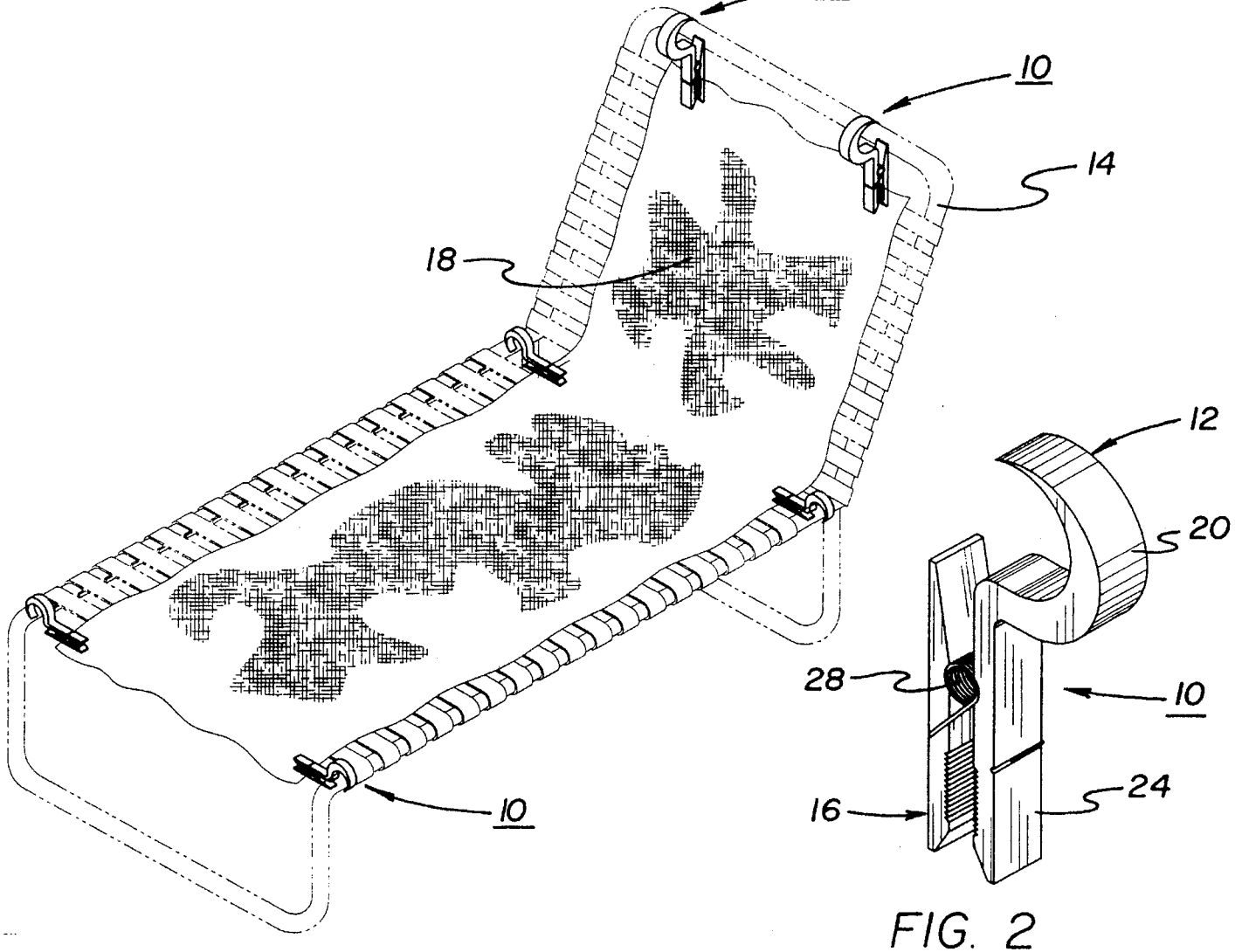
FIG. 1 is an isometric illustration of a plurality of chair attaching towel clips according to the present invention in use.
FIG. 2 is an isometric illustration of a chair attaching towel clip.
Figure 3:
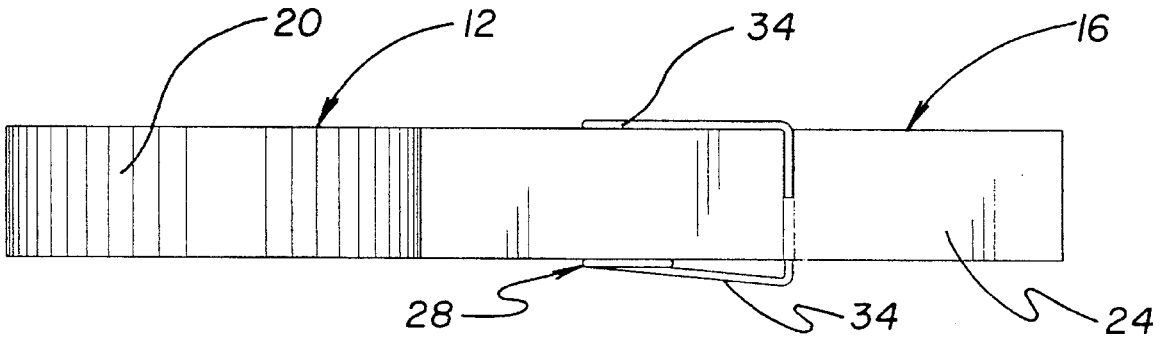
FIG. 3 is a top plan view thereof.
Figure 4:
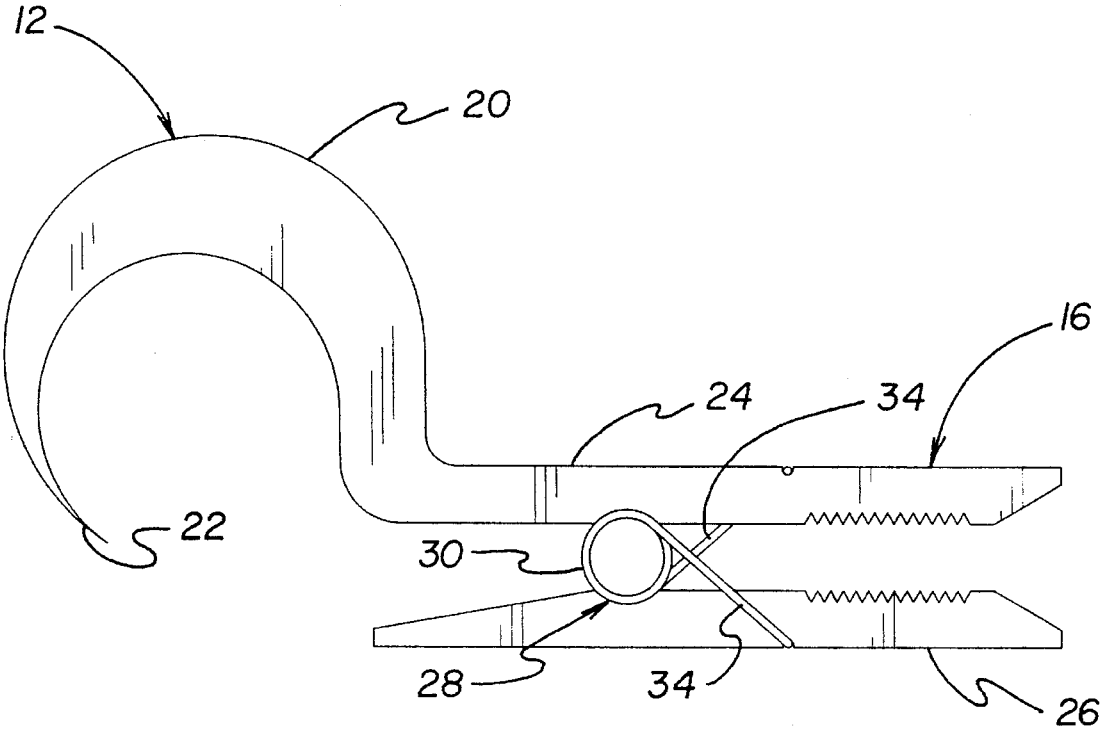
FIG. 4 is a side elevation view of the present invention.
Figure 5:
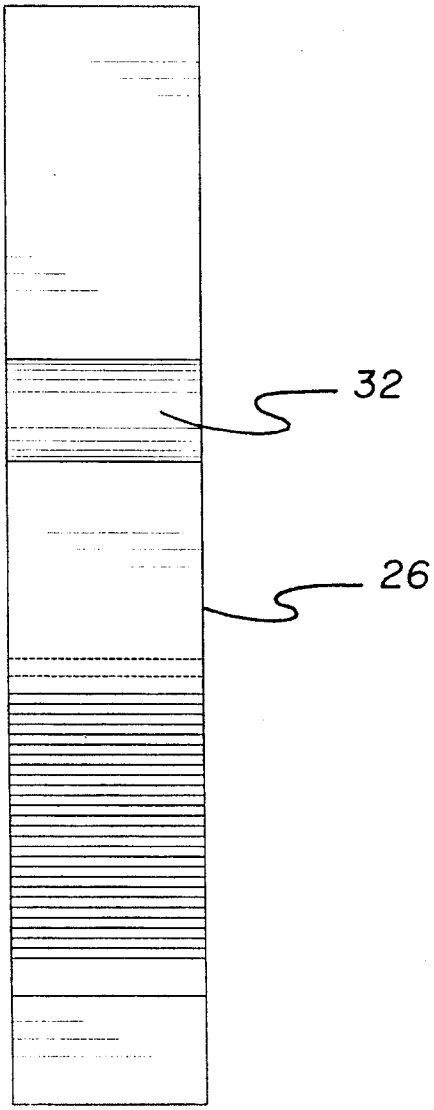
FIG. 5 is an elevation view of a second clamp arm of the invention, per se.
Figure 6:
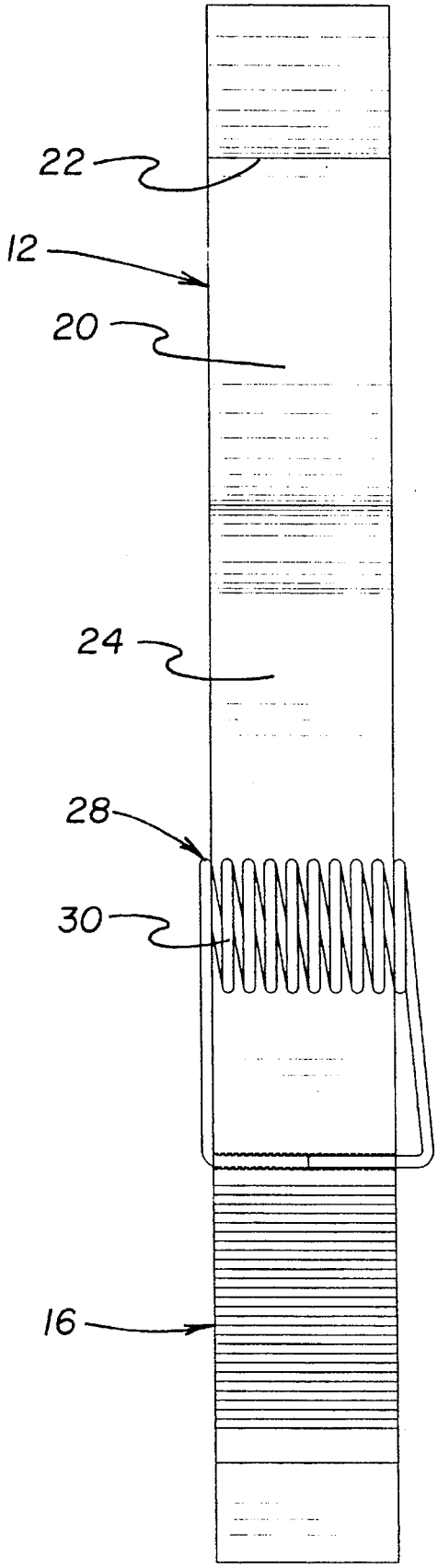
FIG. 6 is an elevation view of the invention with the second clamp arm removed therefrom.

With reference now to the drawings, and in particular to FIGS. 1–6 thereof, a new chair attaching towel clip embodying the principles and concepts of the present invention and generally designated by the reference numeral 10 will be described.

More specifically, it will be noted that the chair attaching towel clip 10 comprises a mounting means 12 for securing to a portion of a chair 14, as shown in FIG. 1 of the drawings. An engaging means 16 is coupled to the mounting means 12 and extends therefrom for engaging a towel 18 so as to secure the towel relative to the chair 14. By this structure, a plurality of the chair attaching towel clips 10 can be coupled to the chair 14 and secured to various portions of the towel 18 as shown in FIG. 1.

Referring now to FIGS. 2 through 6 wherein the present invention 10 is illustrated in detail, it can be shown that the mounting means 12 of the present invention 10 preferably comprises a semi-annular member 20 extending from the engaging means 16 through an arc of greater than one hundred and eighty degrees. The semi-annular member 20 terminates in a free distal end 22 spaced from the engaging means 16 which can be resiliently biased relative to a portion of the semi-annular member 20 proximal to a juncture of the mounting means 12 and the engaging means 16. Preferably, the semi-annular member 20 tapers from a first thickness proximal to the juncture of the mounting means 12 and the engaging means 16 to a second thickness at the free distal end 22 thereof, wherein the second thickness is substantially less than the first thickness so as to permit resilient flexing of the free distal end 22 relative to a major portion of the semi-annular member 20. By this structure, the free distal end 22 can be biased relative to a major portion of the semi-annular member 20 and positioned about a portion of the chair 14, whereby a resilient contraction of the free distal end 22 will cause the semi-annular member 20 to frictionally engage the chair 14 to retain the mounting means 12 relative thereto.

With continuing reference to FIGS. 2 through 6, it can be shown that the engaging means 16 of the present invention 10 preferably comprises an elongated first clamp arm 24 which is integrally or otherwise fixedly secured to the semi-annular member 20. A second clamp arm 26 is supported relative to the first clamp arm 24 by a torsion spring 28 interposed therebetween. The torsion spring 28 includes a center coil 30 which resides within semi-circular recesses 32 formed in both the first and second clamp arms 24 and 26, as shown for the second clamp arm within FIG. 5 of the drawings. The torsion spring 28 further comprises a pair of oppositely projecting spring arms 34 which each engage an individual one of the clamp arms 24 and 26 so as to bias first ends of the clamp arms together, and a second end of the clamp arms apart. By this structure, an individual can manually bias the first ends of the clamp arms 24 and 26 apart by applying a compressive force to the second ends of the clamp arms. A beach towel 18, such as is shown in FIG. 1 of the drawings, can then be inserted between the first ends of the clamp arms, whereby a releasing of the compressive force being applied to the second ends of the clamp arms will permit the first ends thereof to clamp and frictionally engage the towel.

In use, the chair attaching towel clip 10 according to the present invention can be easily utilized for securing a towel relative to a chair. The present invention 10 is preferably constructed of a resilient plastic material or the like which permits the device 10 to be easily transported and attached to an associated beach chair 14.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A chair attaching towel clip, chair and towel combination, said towel clip having a mounting means secured to a frame portion of the chair and an engaging means coupled thereto engaging the towel thereby securing the towel relative to the chair wherein said mounting means comprises a semi-annular member extending from said engaging means through an arc of greater than one hundred and eighty degrees, the semi-annular member terminating in a free distal end, said semi-annular member tapering from a first thickness proximal to the juncture of the mounting means and the engaging means to a second thickness at said free distal end, said second thickness being substantially less than the first thickness whereby the free distal end will resiliently flex relative to a major portion of the semi-annular member to permit positioning about a frame portion of the chair and wherein the subsequent contraction of the free distal end will cause the semi-annular member to be frictionally engaged with with the chair frame, the engaging means comprising an elongated first clamp arm shaped so as to define a semi-circular recess therein and having a first end being fixedly secured to said semi-annular member; a second elongated clamp arm having a semi-circular recess therein complementary to and opposing said recess in said first clamp arm, said second clamp arm being pivotally secured to said first clamp arm; and a torsion spring including a center coil which resides within and between said complementary and opposing semi-circular recesses and which has a pair of oppositely projecting spring arms extending from the center coil, the spring arms each engaging an individual one of the clamp arms so as to bias said clamp arms toward each other with the distal free end of the mounting means facing the torsion spring; an opening of said semi-annular member opening toward said second clamp arm and said free distal end of said semi-annular member being spaced laterally from a first end of said second clamp arm and each of said clamp arms having a means attaching the towel thereto.

* * * * *